US007104240B1

(12) United States Patent
Vuk et al.

(10) Patent No.: US 7,104,240 B1
(45) Date of Patent: Sep. 12, 2006

(54) INTERNAL COMBUSTION ENGINE WITH LOCALIZED LUBRICATION CONTROL OF COMBUSTION CYLINDERS

(75) Inventors: Carl Thomas Vuk, Denver, IA (US); Todd Mathew Whiting, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 11/222,326

(22) Filed: Sep. 8, 2005

(51) Int. Cl.
*F02F 1/20* (2006.01)

(52) U.S. Cl. ..... 123/193.2; 123/196 M; 123/668; 29/888.061; 92/159

(58) Field of Classification Search ..... 123/193.2, 123/668, 196 R, 196 M; 92/153, 158, 159; 29/888.061
See application file for complete search history.

(56) References Cited

U.S. PATENT DOCUMENTS 2,085,976 A * 7/1937 Heintz ..... 92/153
2,434,880 A * 1/1948 Bramberry ..... 29/888.06
3,063,763 A * 11/1962 Zubrisky ..... 384/13
3,620,137 A * 11/1971 Prasse ..... 92/159
3,961,104 A * 6/1976 Tanner ..... 29/888.061
4,258,084 A * 3/1981 Hayden, Sr. ..... 123/193.2
4,993,380 A * 2/1991 Hsu ..... 123/193.2
6,095,107 A * 8/2000 Kloft et al. ..... 123/193.2

* cited by examiner

*Primary Examiner*—Erick R Solis

(57) ABSTRACT

An internal combustion engine includes at least one cylinder block having at least one combustion cylinder. A number of cylinder liners are respectively associated with each combustion cylinder. Each cylinder liner defines a corresponding cylinder inside surface. Each cylinder liner includes a plurality of discrete oil retaining indentations in a predefined pattern on the cylinder inside surface. The plurality of oil retaining indentations are bounded in both peripheral and longitudinal directions of the corresponding cylinder liner.

22 Claims, 2 Drawing Sheets

INTERNAL COMBUSTION ENGINE WITH LOCALIZED LUBRICATION CONTROL OF COMBUSTION CYLINDERS

FIELD OF THE INVENTION

The present invention relates to internal combustion engines, and, more particularly, to lubrication of combustion cylinders in such engines.

BACKGROUND OF THE INVENTION

In an internal combustion (IC) engine, when a piston reciprocally moves in sliding contact within the cylinder, friction and wear are most severe at top dead center (TDC) and bottom dead center (BDC) of the stroke positions of the piston. At these exact points where the piston changes direction, a condition of zero velocity occurs causing a reduction in hydrodynamic oil film thickness which can lead to metal-to-metal contact. This condition is most severe at TDC because lubricating oil on the surface is exposed to combustion temperatures which may cause unfavorable changes in its viscosity. This condition renders it more difficult to retain oil in the pores of the metal surfaces, accelerating the oil film diminishment rate subsequent to when the liner is wiped clean by the oil wipe rings situated beneath the combustion rings of the piston.

It is known to hone the inside surface of a combustion cylinder to produce scratches that retain lubricant oil. For example, a commonly used plateau honing operation provides deep scratches extending entirely around the inside surface of the combustion cylinder that retain lubricant oil. A second honing operation provides a smooth finish for the piston ring and piston to ride on. The deep scratches are not well controlled and are not conducive to the build up of a good squeeze film or hydrodynamic oil film.

What is needed in the art is an internal combustion engine providing improved oil lubrication of the combustion cylinders and reduced oil consumption.

SUMMARY OF THE INVENTION

The present invention provides an internal combustion engine including a combustion cylinder having an inside surfaces which is ablated to have discrete pock marks which vary in density distribution along the length of the combustion cylinder.

The invention comprises, in one form thereof, an internal combustion engine including at least one cylinder block having at least one combustion cylinder. A number of cylinder liners are respectively associated with each combustion cylinder. Each cylinder liner defines a corresponding cylinder inside surface. Each cylinder liner includes a plurality of discrete oil retaining indentations in a predefined pattern on the cylinder inside surface. The plurality of oil retaining indentations are bounded in both peripheral and longitudinal directions of the corresponding cylinder liner.

An advantage of the present invention is that the discrete indentations formed as pock marks better hold oil than conventional scratches formed in the inside surface of a combustion cylinder.

Another advantage is that the discrete indentations decrease radiation and convection heat transfer, thereby reducing volotization and pyrolysis.

Yet another advantage is that the discrete indentations provide lower oil consumption, longer particulate trap life and better performance.

A still further advantage is that the discrete indentations provide lower friction and wear resulting in longer engine life and better fuel economy.

A still further advantage is that multiple ablation manufacturing methods may be used to form the discrete indentations in the inside surface of the cylinder liner.

A further advantage is that the discrete indentations may be formed with precise uniformity and spacing.

Another advantage is that the improved oil lubrication using discrete indentations provides very low emissions levels and reduces contamination of after treatment devices.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
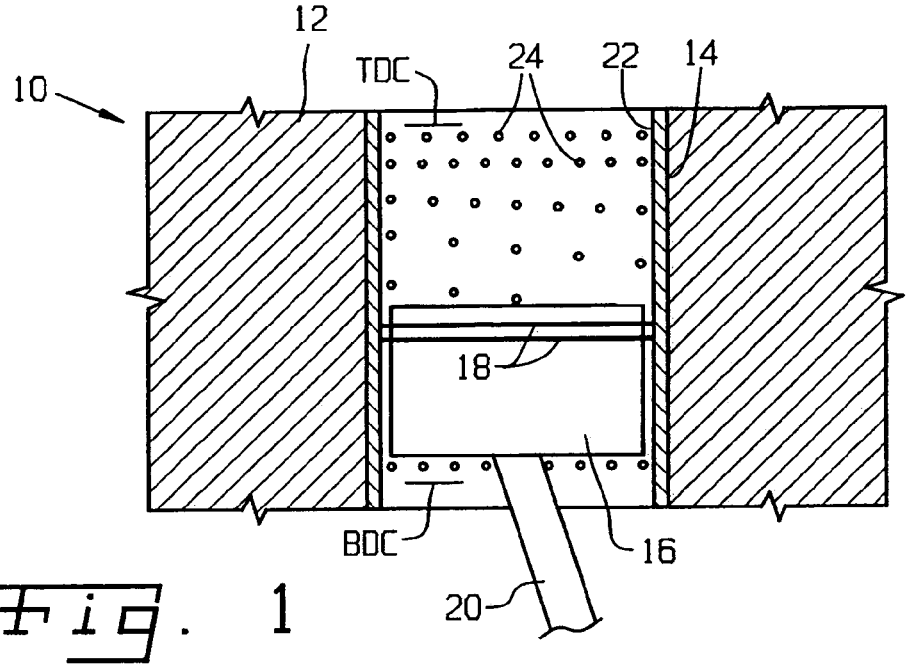
FIG. 1 is a schematic, sectional view of a portion of a cylinder block of an internal combustion engine, illustrating an embodiment of discrete indentations of the present invention.

Referring now to the drawings, and more particularly to FIG. 1, there is shown a portion of an IC engine 10 of the present invention. IC engine 10 generally includes a cylinder block 12, cylinder liner 14, piston 16 carrying a pair of piston rings 18, and connecting rod 20 interconnecting piston 16 with a crankshaft (not shown). It will be appreciated that although IC engine 10 is shown with a single cylinder block 12 carrying a single cylinder liner 14, IC engine 10 typically includes multiple cylinder blocks 12, with each cylinder block carrying multiple cylinder liners defining multiple cylinders.

Piston 16 is reciprocally movable within cylinder liner 14 between a TDC position and a BDC position, indicated generally in FIG. 1. Connecting rod 20 in known manner is reciprocally connected to the crank shaft and pivotally connected to piston 16 via a pin (not shown), such that connecting rod 20 moves through an angular arc upon reciprocating movement of piston 16 within cylinder liner 14.

At the TDC position and the BDC position, piston 16 reverses reciprocating movement within cylinder liner 14, and thus reaches a piston speed of zero at the TDC and BDC positions. When moving from the TDC position to the BDC position, or vice versa, piston 16 is accelerated and reaches a maximum piston speed approximately at the center of the piston stroke.

Figure 2:
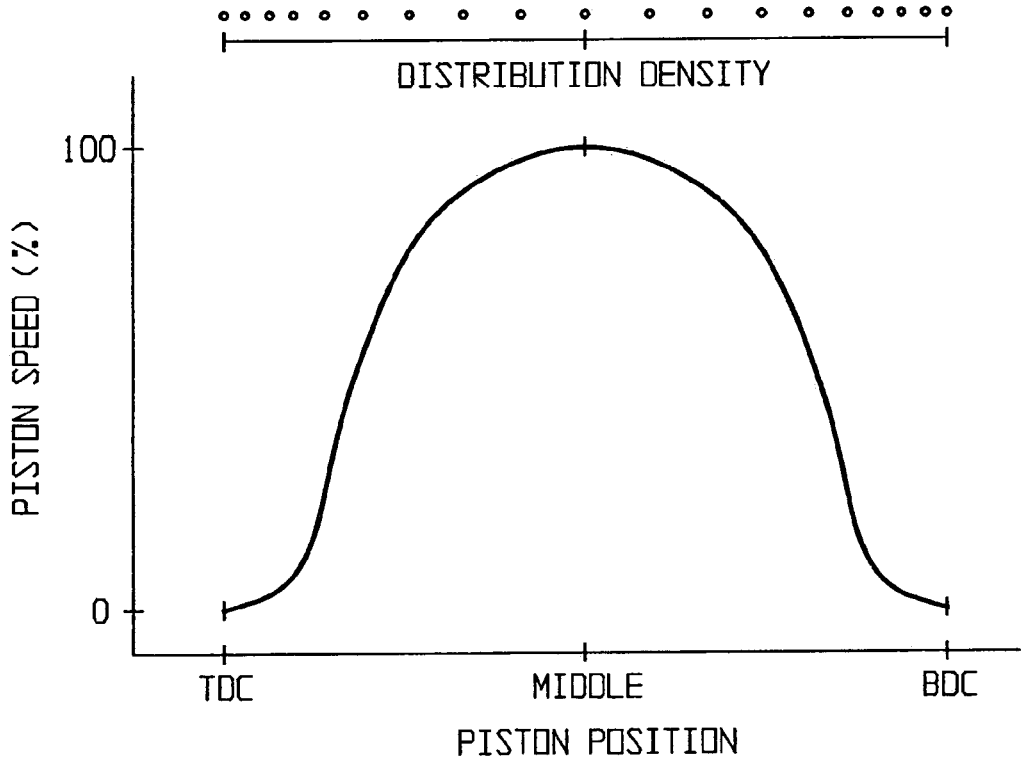
FIG. 2 is a graphical illustration of a relationship between piston position, speed and density distribution of the discrete indentations of the present invention.

From an oil lubrication perspective, the worst case position of piston 16 during a piston stroke is at the TDC position, whereat piston 16 is at a zero traveling speed and the operating temperate is the highest as a result of combustion at or near the TDC position. High combustion gas pressures at TDC apply high loads to the piston rings, decreasing the oil film thickness. The traveling speed of piston 16 as a result of the piston position within cylinder liner 14 is graphically illustrated in FIG. 2.

Cylinder liner 14 includes an inside surface 22 against which piston rings 18 slide. As described above, inside surface 22 is conventionally formed with a plurality of generally annularly extending deep scratches which retain oil for lubrication of piston 16 and rings 18. Since the scratches are typically formed with a specified honing operation, the scratches extend around the entire periphery of inside surface 22. Control of the exact position of the scratches is not easily accomplished, since the exact positioning of the scratches depends upon the rotational speed, axial feed rate and characteristics of the honing tool.

In contrast, the present invention forms a plurality of discrete oil retaining indentations at inside surface 22 of cylinder liner 14, which are preferably in the form of pock marks. Rather than extending around the entire periphery of inside surface 22 as is the case with annularly extending scratches, pock marks 24 are bounded in both peripheral and longitudinal directions of cylinder liner 14.

According to another aspect of the present invention, the distribution density of pock marks 24 is dependent upon a longitudinal position on cylinder liner 14. Since the oil lubrication needs are greater at the TDC and BDC positions, pock marks 24 have a distribution density which is greater at the longitudinal ends of cylinder liner 14 and less at the longitudinal middle of cylinder liner 14. In other words, the distribution density of pock marks 24 is greater at the TDC and BDC positions. A distribution density which is greater at the TDC and BDC positions and less at the middle position of cylinder liner 14 is shown in FIG. 1, and illustrated graphically in FIG. 2.

In the embodiment shown in FIG. 1, pock marks 24 are formed with a generally spiral pattern on inside surface 22 of cylinder liner 14. The spiral pattern has a lesser pitch at the longitudinal ends of cylinder liner 14 (corresponding to the greater distribution density), and a greater pitch at the longitudinal middle of cylinder liner 14 (corresponding to the lesser distribution density). The exact angular pitch of course depends upon the desired distribution density, and varies from one application to another.

Figure 3A:
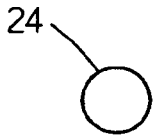
FIGS. 3A and 3B are top and side representations of one embodiment of a discrete indentation of the present invention.
Figure 3B:
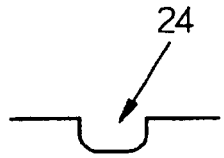

Pock marks 24 have a generally dot shape as shown in FIG. 1, and illustrated in more detail in FIGS. 3A and 3B. Each dot shaped pock mark has a depth of between approximately 5 to 20 microns, preferably approximately 10 microns. Additionally, each dot shaped pock mark has a diameter of between approximately 50 to 100 microns. Dot shaped pock marks with these dimensions have been shown to be effective in retaining oil for lubrication of piston 16 and rings 18.

Cylinder liner 14 may be formed from any suitable liner material allowing formation of pock marks 24, such as iron, steel, etc. Liners formed from iron are typically much more common than liners formed from steel, since iron includes graphite pockets which retain oil for lubrication. With the present invention, steel liners can also be used since pock marks 24 likewise retain oil for lubrication. Steel liners have the advantage of being much stronger than iron liners.

Figure 4A:
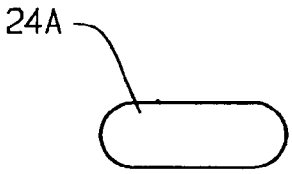
FIGS. 4A and 4B are top and side representations of another embodiment of a discrete indentation of the present invention.
Figure 4B:
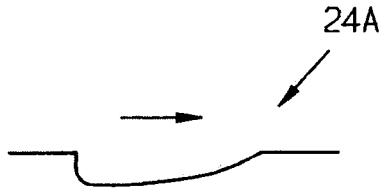

In another embodiment illustrated in FIGS. 4A and 4B, indentations or pock marks 24 have an elliptical shape with a bottom surface which tapers in the running direction of piston 16. For example, pock marks near the TDC position may have an elliptical shape with a major axis extending parallel to the longitudinal axis of cylinder liner 14, and a bottom surface which tapers toward the upper end of cylinder liner 14 so that a squeeze film of oil is created near the TDC position for maximum lubrication of rings 18.

Figure 5A:
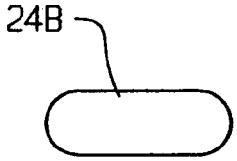
FIGS. 5A and 5B are top and side representations of yet another embodiment of a discrete indentation of the present invention.
Figure 5B:
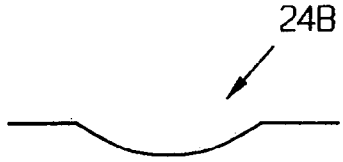

FIGS. 5A and 5B illustrate another example of a pock mark 24*b* which is configured to create a squeeze film of lubricating oil in both directions, such as may be desirable near the longitudinal middle of cylinder liner 14 during reciprocating movement of piston 16.

During manufacture, cylinder liner 14 is formed with pock marks 24 as described above, prior to being pressed within cylinder block 12. In one embodiment, pock marks 24 are formed on inside surface 22 using a photolithography ablation process, similar to a photolithography ablation process used on ceramics in the micro-electronics industry. In general, a photosensitive layer is placed on inside surface 22 and exposed to light to remove portions of the photosensitive layer. The light preferably is produced by a laser which is targeted at selected locations on inside surface 22 where the pock marks are desired to be formed. The laser can be controllably movable to aim the laser at the selected pock mark locations. Alternatively, cylinder liner 14 can be rotated and moved in a longitudinal direction relative to a stationary laser which is then actuated at selected locations to remove portions of the photosensitive layer. The cylinder liner is then exposed to an etching agent, such as an acid, to remove material from inside surface 22 at selected pock mark locations. The dot shaped pock mark shown in FIGS. 3A and 3B may be formed using a photolithography or other suitable chemical etching manufacturing process.

In another embodiment, pock marks 24 may be formed using a laser ablation process in which the laser is configured to actually remove material from inside surface 22 of cylinder liner 14. This type of ablation process may be more suitable for forming the custom shaped pock marks as shown in FIGS. 4A and 4B, and 5A and 5B.

In the embodiment shown and described above, oil retaining indentations are formed in the inside surface of a cylinder in an IC engine. However, it should be understood that such oil retaining indentations may be formed in other reciprocating piston and cylinder arrangements, such as a fluid compressor (e.g., air compressor).

Having described the preferred embodiment, it will become apparent that various modifications can be made without departing from the scope of the invention as defined in the accompanying claims.

The invention claimed is:

1. An internal combustion engine, comprising:

at least one cylinder block including at least one combustion cylinder and at least one cylinder liner, each said cylinder liner associated with a respective said combustion cylinder and defining a corresponding said cylinder inside surface, each said cylinder liner including a plurality of discrete oil retaining indentations in a predefined pattern on said cylinder inside surface, said plurality of indentations having a varying distribution density dependent upon a longitudinal position along said cylinder liner, said oil retaining indentations having defined proportions bounded in both peripheral and longitudinal directions of said corresponding cylinder liner.

2. The internal combustion engine of claim 1, wherein said plurality of indentations have a distribution density which is greater at said longitudinal ends of said cylinder liner and less at said longitudinal middle of said cylinder liner.

3. The internal combustion engine of claim 1, wherein said plurality of indentations comprise a plurality of pock marks in a generally spiral pattern in said cylinder inside surface.

4. The internal combustion engine of claim 3, wherein said spiral pattern has a lesser pitch at said longitudinal ends of said cylinder liner and a greater pitch at said longitudinal middle of said cylinder liner.

5. The internal combustion engine of claim 1, wherein each said indentation has a depth of between approximately 5 to 20 microns.

6. The internal combustion engine of claim 5, wherein each said indentation has a depth of approximately 10 microns.

7. The internal combustion engine of claim 1, wherein each said indentation comprises a dot having a diameter of between approximately 50 to 100 microns.

8. The internal combustion engine of claim 1, wherein each said indentation has an elliptical shape with a depth tapering toward a longitudinal end of said cylinder liner.

9. The internal combustion engine of claim 1, wherein each said cylinder liner is comprised of one of steel and iron.

10. An internal combustion engine, comprising:

at least one cylinder block including at least one combustion cylinder, each said combustion cylinder including a cylinder inside surface;

at least one piston, each said piston associated with a respective said combustion cylinder and reciprocally movable between a top dead center position and a bottom dead center position; and wherein said cylinder inside surface has a plurality of discrete oil retaining indentations with a varying distribution density which is greater when said piston is at said top dead center position and said bottom dead center position, said oil retaining indentations having defined proportions bounded in both peripheral and longitudinal directions of the cylinder.

11. The internal combustion engine of claim 10, including at least one cylinder liner, each said cylinder liner associated with one said combustion cylinder and defining a corresponding said cylinder inside surface.

12. The internal combustion engine of claim 11, wherein each said cylinder liner is comprised of one of steel and iron.

13. The internal combustion engine of claim 10, wherein said plurality of indentations comprise a plurality of pock marks in a generally spiral pattern in said cylinder inside surface.

14. The internal combustion engine of claim 13, wherein said spiral pattern has a lesser pitch at said longitudinal ends of said cylinder liner and a greater pitch at said longitudinal middle of said cylinder liner.

15. The internal combustion engine of claim 10, wherein each said indentation has a depth of between approximately 5 to 20 microns.

16. The internal combustion engine of claim 15, wherein each said indentation has a depth of approximately 10 microns.

17. The internal combustion engine of claim 10, wherein each said indentation comprises a dot having a diameter of between approximately 50 to 100 microns.

18. The internal combustion engine of claim 10, wherein each said indentation has an elliptical shape with a depth tapering toward a longitudinal end of said cylinder liner.

19. A piston and cylinder arrangement, comprising: at least one cylinder with a corresponding cylinder inside surface, each said inside surface including a plurality of discrete oil retaining indentations in a predefined pattern, said plurality of indentations having a varying distribution density dependent upon a longitudinal position along said inside surface, said plurality of oil retaining indentations having defined proportions bounded in both peripheral and longitudinal directions of said inside surface.

20. The piston and cylinder arrangement of claim 19, wherein said plurality of indentations have a distribution density which is greater at longitudinal ends of said cylinder and less at a longitudinal middle of said cylinder.

21. The piston and cylinder arrangement of claim 19, including a cylinder block defining said at least one cylinder.

22. The piston and cylinder arrangement of claim 19, wherein said piston and cylinder arrangement is part of one of an IC engine and a compressor.

* * * * *